US010470979B2

(12) United States Patent
Tepper et al.

(10) Patent No.: US 10,470,979 B2
(45) Date of Patent: Nov. 12, 2019

(54) INTELLIGENT PACIFIER

(71) Applicant: Hive Design, Inc., Los Gatos, CA (US)

(72) Inventors: Mark Tepper, San Francisco, CA (US); Lesley Tepper, San Francisco, CA (US); Loren Vittetoe, New York, NY (US); Andrew Straub, New York, NY (US); Shane Rogers, Los Gatos, CA (US)

(73) Assignee: HIVE DESIGN, INC., Los Gatos, CA (US)

( * ) Notice: Subject to any disclaimer, the term of this patent is extended or adjusted under 35 U.S.C. 154(b) by 222 days.

(21) Appl. No.: 15/414,310

(22) Filed: Jan. 24, 2017

(65) Prior Publication Data

US 2018/0207065 A1 Jul. 26, 2018

(51) Int. Cl.
*A61J 17/00* (2006.01)

(52) U.S. Cl.
CPC ..... *A61J 17/001* (2015.05); *A61J 17/002* (2015.05); *A61J 17/003* (2015.05); *A61J 17/005* (2015.05); *A61J 2200/70* (2013.01)

(58) Field of Classification Search
CPC .... A61J 17/001; A61J 17/003; A61J 2200/70; A61J 17/002; A61J 17/005
See application file for complete search history.

(56) References Cited

U.S. PATENT DOCUMENTS 5,211,479 A 5/1993 Coffey
5,522,847 A 6/1996 Kalis
5,844,862 A 12/1998 Cocatre-Zilgien
5,853,005 A 12/1998 Scanlon
5,859,585 A * 1/1999 Fleming ..... G08B 21/24 340/539.32
6,033,367 A 3/2000 Goldfield
6,193,742 B1 2/2001 Moriarty
(Continued)

FOREIGN PATENT DOCUMENTS

CA 2385573 4/2001
CN 1844869 10/2006
(Continued)

OTHER PUBLICATIONS

Unknown, "Smart thermometer pacifier," https://www.bluemaestra.com/smart-thermometer-pacifier/ (last accessed Mar. 9, 2017).

*Primary Examiner* — Elias Desta
(74) *Attorney, Agent, or Firm* — Maschoff Brennan

(57) ABSTRACT

An intelligent pacifier estimates its state based on one or more sensors. Based on the estimated state, the pacifier may provide an alert or notification to a child or caretaker regarding the state of the child. The alert or notification may be generated by one or more output transducers and may increase in level depending on the estimated state. An application program communicates with the intelligent pacifier, allowing the caretaker to review and analyze the data collected by the intelligent pacifier, and to configure the intelligent pacifier. Embodiments of the intelligent pacifier may vary in the number and type of sensors, the number and type of estimated states, and the number and type of output transducers. The intelligent pacifier may be constructed as a single device or may consist of a housing that interfaces to a typical pacifier.

20 Claims, 12 Drawing Sheets

(56) References Cited

U.S. PATENT DOCUMENTS

| | | | | |
|---|---|---|---|---|
| 6,470,200 | B2 | 10/2002 | Walker | |
| 6,553,336 | B1 * | 4/2003 | Johnson | G01D 3/022 702/188 |
| 6,591,140 | B2 | 7/2003 | Strome | |
| 8,686,861 | B2 * | 4/2014 | Chung | G01S 5/0018 340/10.4 |
| 9,220,654 | B2 | 12/2015 | Barlow | |
| 9,452,270 | B2 | 9/2016 | Addington | |
| 10,002,359 | B2 * | 6/2018 | Atkinson | G06Q 30/018 |
| 2001/0044588 | A1 | 11/2001 | Mault | |
| 2002/0017997 | A1 | 2/2002 | Felkowitz | |
| 2002/0028990 | A1 | 3/2002 | Shepherd | |
| 2005/0245839 | A1 | 11/2005 | Stivoric | |
| 2006/0074354 | A1 | 4/2006 | Barlow | |
| 2007/0049972 | A1 * | 3/2007 | Jones | G08B 21/24 606/234 |
| 2007/0175473 | A1 | 8/2007 | Lewis | |
| 2008/0142019 | A1 | 6/2008 | Lewis | |
| 2009/0156967 | A1 | 6/2009 | Cohen | |
| 2009/0157477 | A1 | 6/2009 | Cohen | |
| 2009/0198275 | A1 | 8/2009 | Godown | |
| 2010/0016675 | A1 | 1/2010 | Cohen | |
| 2012/0172679 | A1 | 7/2012 | Logan | |
| 2012/0186582 | A1 | 7/2012 | Addington | |
| 2012/0190999 | A1 | 7/2012 | Addington | |
| 2012/0277794 | A1 | 11/2012 | Kountotsis | |
| 2012/0302924 | A1 | 11/2012 | Cunningham | |
| 2013/0192594 | A1 | 8/2013 | Addington | |
| 2014/0202457 | A1 | 7/2014 | Addington | |
| 2014/0207024 | A1 | 7/2014 | Aron | |
| 2014/0220520 | A1 | 8/2014 | Salamini | |
| 2014/0261400 | A1 | 9/2014 | Addington | |
| 2015/0196247 | A1 | 7/2015 | Lau | |
| 2015/0208979 | A1 | 7/2015 | Cunningham | |
| 2015/0288877 | A1 | 10/2015 | Glazer | |
| 2016/0174841 | A1 | 6/2016 | Proud | |
| 2016/0292388 | A1 | 10/2016 | Lee | |
| 2016/0367188 | A1 * | 12/2016 | Malik | A61B 5/682 |

FOREIGN PATENT DOCUMENTS

| | | | |
|---|---|---|---|
| CN | 200980833 | Y | 11/2007 |
| CN | 201275278 | Y | 7/2009 |
| CN | 201324381 | Y | 10/2009 |
| CN | 201658361 | U | 12/2010 |
| CN | 203595957 | U | 5/2014 |
| CN | 104257358 | | 1/2015 |
| CN | 204581995 | U | 8/2015 |
| CN | 105228576 | | 1/2016 |
| DE | 102011077515 | A1 | 12/2012 |
| EP | 0166069 | A1 | 1/1986 |
| EP | 2092882 | A2 | 8/2009 |
| JP | 2003521972 | A | 7/2003 |
| JP | 5237208 | B2 | 7/2013 |
| RU | 63690 | U1 | 6/2007 |
| RU | 130846 | U1 | 8/2013 |
| WO | 1997040748 | | 11/1997 |
| WO | 2001028416 | | 4/2001 |
| WO | 2014159016 | | 10/2014 |
| WO | 2014164175 | | 10/2014 |
| WO | 2014164241 | | 10/2014 |
| WO | 2014164243 | | 10/2014 |
| WO | 2016154119 | | 4/2016 |
| WO | 2016155024 | | 10/2016 |

* cited by examiner

FIGURE 9

| Pacifier Environment State | Pressure | Humidity | Temp. | Proximity | Motion | Optical | Sound |
|---|---|---|---|---|---|---|---|
| Not in use, needed (child in discomfort) | C=0 | T=0<br>C=0 | T=0 | T=0 | T=1<br>C=0 | N/A | T=1<br>C=0 |
| Not in use, needed (child in distress) | C=0 | T=0<br>C=0 | T=0 | T=0 | T=1<br>C=0 | N/A | T=1<br>C=1 |
| Not in use, not needed | C=0 | T=0<br>C=0 | T=0 | T=0 | T=0<br>C=0 | N/A | T=0<br>C=0 |
| In hand | C=0 | T=0<br>C=0 | T=0 | T=1 | T=1<br>C=0 | N/A | T=0<br>C=0 |
| In use | C=1 | T=1<br>C=1 | T=1 | T=1 | T=0<br>C=1 | N/A | T=0<br>C=0 |
| C = Characteristic Check; T = Threshold Check<br>1 = Pass; 2 = Fail | | | | | | | |

INTELLIGENT PACIFIER

CROSS-REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Raising a child is a demanding task. Pacifiers are commonly employed to calm infants and young children. It would be beneficial if the pacifier aided the caretaker in the process of raising the child.

BRIEF SUMMARY OF THE INVENTION

This disclosure relates to an intelligent pacifier that responds to a distressed child with a visual, audible, or tactile notification to aid the child or a caretaker (e.g., a parent, relative, babysitter, or nanny) in locating the pacifier to satisfy the three basic learning styles, auditory, visual, and kinesthetic. The notification may increase or decrease in level or intensity and frequency depending on the detected level of distress. The pacifier may detect distress based on default settings, configured settings, or learned settings. Data collected by the pacifier may be transferred to another device having a display in real time or periodically so that the caretaker has access to the data collected by the pacifier.

In one embodiment, an apparatus comprises an interface to a pacifier; a sensor configured to sense an environmental condition of the pacifier; a processor configured to estimate a state of the pacifier based in part on the environmental condition; and a transducer configured to generate a notification of the location of the pacifier based in part on the state of the pacifier. The processor may be further configured to change the notification based in part on a change in the state of the pacifier. The apparatus may further comprise a communications interface configured to receive data from processor and to transmit the data to an external device. The processor may be further configured to evaluate a signal from the sensor in estimating the state of the pacifier. The state of the pacifier may include an indication of whether the pacifier is in use. The environmental condition may include one or more of a humidity, a motion, a temperature, a sound, an air pressure, and a proximity to an object and/or person. The notification may include one or more of a light, a movement (e.g., a vibration), and a sound. The interface may secure the pacifier such that a portion of the apparatus is partially inserted into a hollow in a nipple of the pacifier. The interface may secure the pacifier such that a portion of the apparatus partially occludes a hollow in a nipple of the pacifier.

In another embodiment, a pacifier comprises a sensor configured to sense an environmental condition of the pacifier; a processor configured to evaluate a state of the pacifier based in part on the environmental condition; and a transducer configured to generate a notification of the location of the pacifier based in part on the state of the pacifier. The processor may be further configured to change the notification based in part on a change in the state of the pacifier. The pacifier may further comprise a communications interface configured to receive data from processor and to transmit the data to an external device. The processor may be further configured to evaluate the frequency content of a signal from the sensor to evaluate the state of the pacifier. The state of the pacifier may include an indication of whether the pacifier is in use. The environmental condition may include one or more of a humidity, a motion, a temperature, a sound, an air pressure, and a proximity to an object. The notification may include one or more of a light, a movement, and a sound. In estimating the state of the pacifier, the processor may compare data received from the sensor representative of the environmental condition against a threshold. In estimating the state of the pacifier, the processor may compare data received from the sensor representative of the environmental condition against a characteristic.

In another embodiment, a system comprises a first device and a second device. The first device comprises a sensor configured to sense an environmental condition of a pacifier; a processor configured to evaluate a state of the pacifier based in part on the environmental condition and a parameter; a transducer configured to generate a notification of the location of the pacifier based in part on the state of the pacifier; and a communications interface configured to transmit information about the environmental condition of the pacifier and to receive the parameter. The second device comprises a display; a communications interface; and a processor configured to execute an application program that (1) receives information about the environmental condition of the pacifier via the communications interface; (2) transmits the parameter to the first device via the communications interface; and (3) causes the display to output a visual indication of the environmental condition of the pacifier based on the received information. The processor of the second device may be configured to cause the display to output a user interface, the user interface having a parameter input field.

The intelligent pacifier benefits caretakers by enabling infants and small children to help locate a lost or dropped pacifier. Additionally, the pacifier may reduce the effort required to locate it should it become misplaced. An application running on an external device may receive data collected from various sensors included on the pacifier to provide a caretaker a more thorough understanding of the child's biometrics. By allowing archival of captured data, the caretaker can analyze the data or share the biometrics with, for example, a pediatrician. These and other benefits will be readily apparent to one of skill in the art based on the following description.

BRIEF DESCRIPTION OF THE SEVERAL VIEWS OF THE DRAWINGS

FIG. 9 is a table that depicts how a processor may estimate the state of the pacifier based on sensor data.

The figures depict various example embodiments of the present disclosure for purposes of illustration only. One skilled in the art will readily recognize from the following discussion that other example embodiments based on alternative structures and methods may be implemented without departing from the principles of the disclosure.

DETAILED DESCRIPTION OF THE INVENTION

The figures and the following description describe certain embodiments by way of illustration only. One skilled in the art will readily recognize from the following description that alternative embodiments of the structures and methods illustrated herein may be employed without departing from the principles described herein. Reference will now be made in detail to several embodiments, examples of which are illustrated in the accompanying figures. It is noted that wherever practicable similar or like reference numbers may be used in the figures and may indicate similar or like functionality.

Pacifier and Housing Construction

Figure 1A:
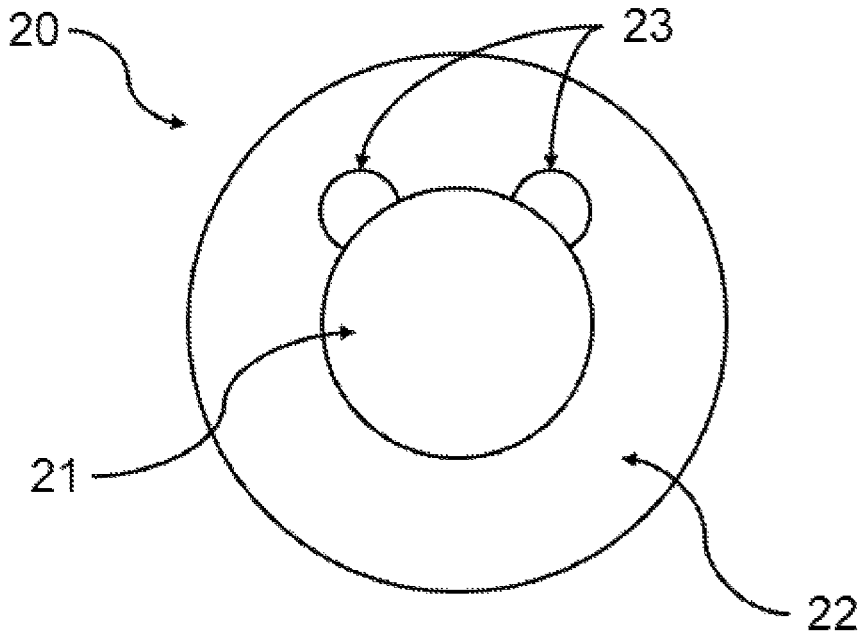
FIGS. 1A and 1B depict a pacifier.
Figure 1B:
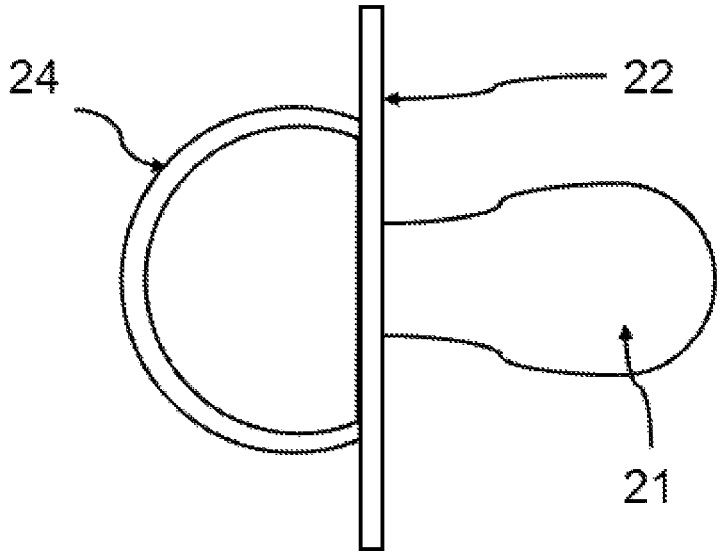

FIG. 1 depicts the typical components of an infant or child pacifier 20. Pacifier 20 includes a nipple 21, a guard or shield 22, a handle 24, and ventilation holes 23 to allow air flow between the child's mouth and the guard or shield 22 when the child is sucking on the nipple 20.

Figure 2A:
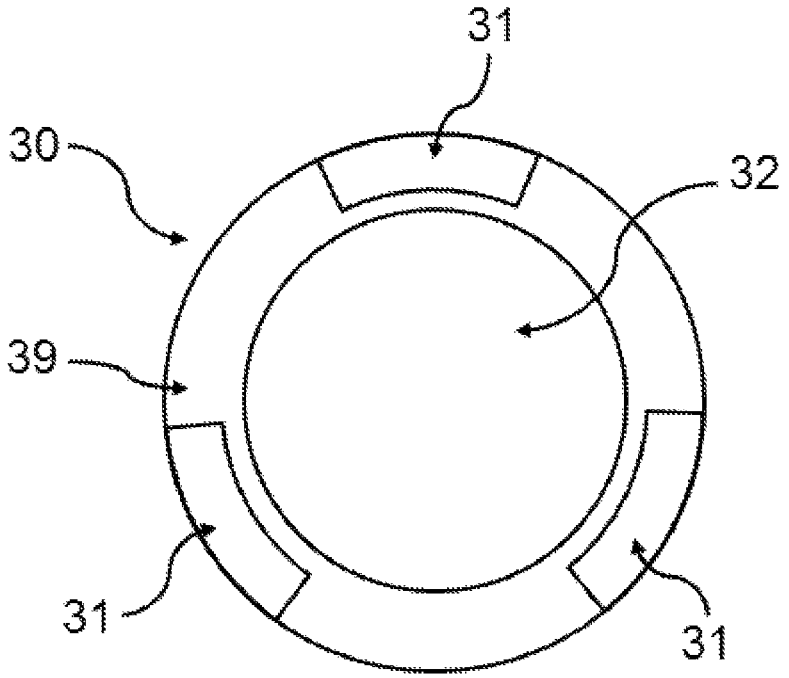
FIGS. 2A and 2B are front and side views of a housing that interfaces to a pacifier.
Figure 2B:
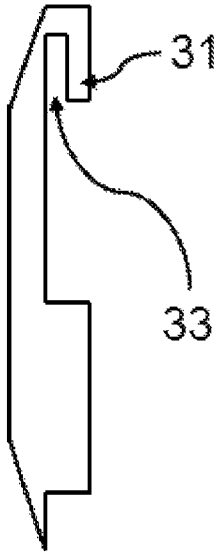
Figure 3A:
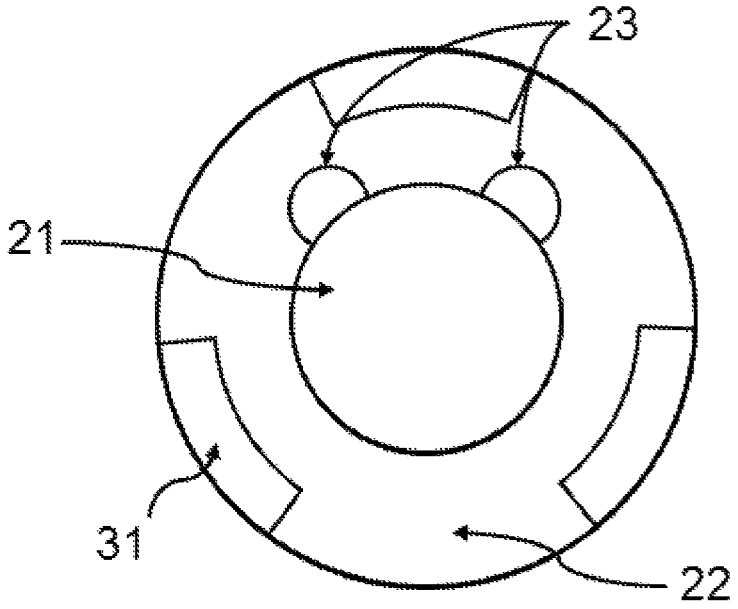
FIGS. 3A and 3B are front and side views of the housing shown in FIGS. 2A and 2B when coupled to the pacifier shown in FIG. 1.
Figure 3B:
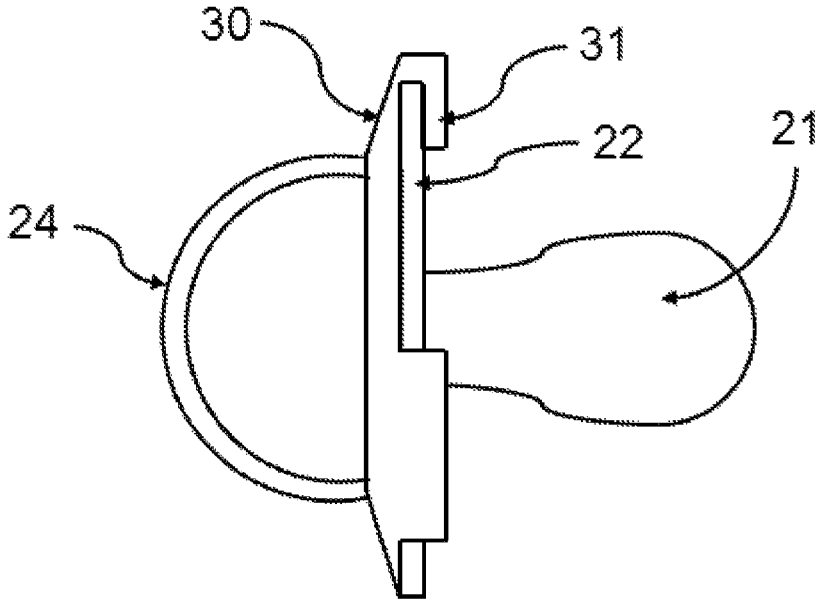

FIGS. 2A and 2B depict one embodiment of a housing 30 that may interface to a pacifier. As described below, the housing includes electronic components, described below in the context of FIG. 6. In this embodiment, the main portion 39 ring shaped having flanges 31 to secure to a pacifier guard in a recess 33 between the main portion 39 and the flanges 31. The opening 32 allows the nipple, handle, and ventilation holes of a pacifier to remain unobstructed, as shown in FIGS. 3A and 3B. At least one of the housing 30, the flanges 31, or the pacifier guard 22 is preferably pliable to facilitate installation of the pacifier in the housing. Alternatively, a front and back face of the housing 30 may be separable allowing insertion of the pacifier 20. In that situation, the front and back faces may fasten together via one or more fasteners or threading on an internal surface of the faces.

Figure 4A:
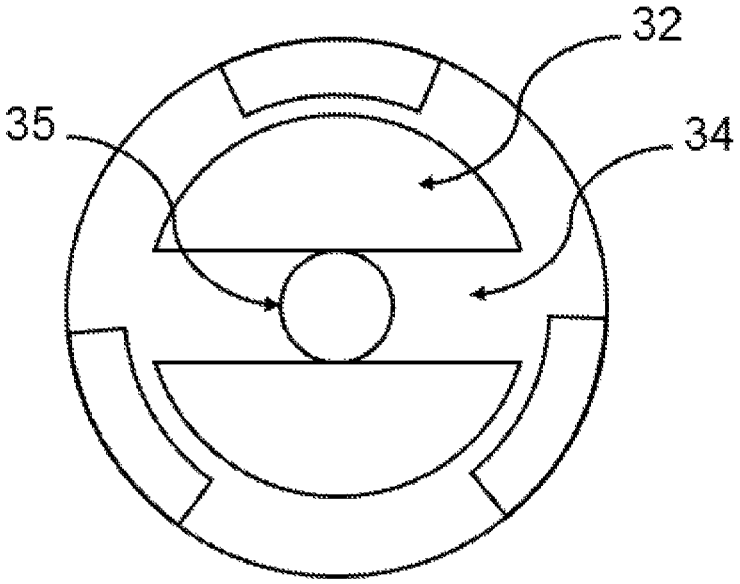
FIGS. 4A and 4B are front and side views of another embodiment of a housing.
Figure 4B:
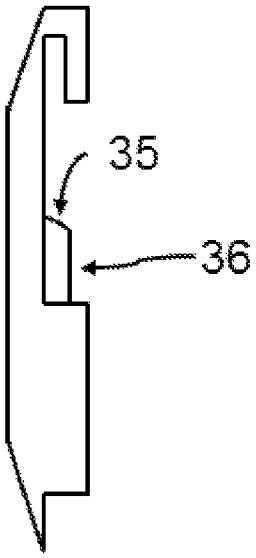

FIGS. 4A and 4B depict another embodiment of a housing like the one previously described. In this embodiment, a member 34 spans the main portion of the housing across opening 32 to provide a surface 36 on which to mount one or more sensors behind the hollow portion of a pacifier nipple. Surface 36 may be raised via a platform 35 to partially or completely seal or occlude an opening in the hollow portion of the nipple.

Figure 5A:
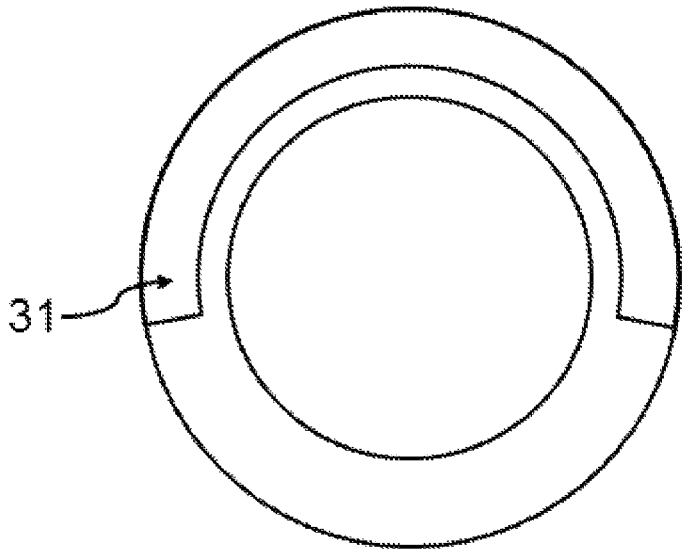
FIGS. 5A-5C are front views of additional embodiments of a housing.
Figure 5B:
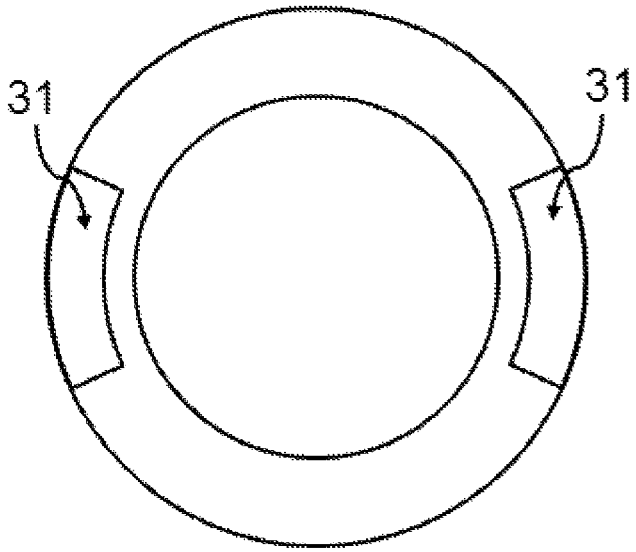
Figure 5C:
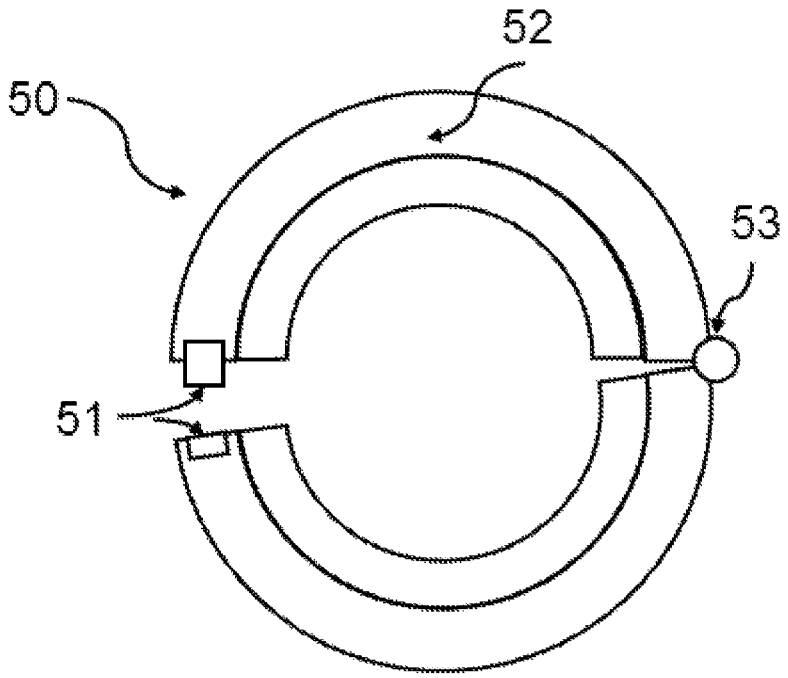

FIGS. 5A, 5B, and 5C depict further embodiments of housings having different configurations. The housing depicted in FIG. 5A has a single flange 31. If the pacifier guard and housing are rigid or semi rigid, the pacifier may snap into such a housing. FIG. 5B depicts a housing having two flanges 31. FIG. 5C depicts a housing 50 in the form of a collar having a hinge 53 and fastener 51. When a pacifier is installed in this embodiment, flange 52 completely encircles the pacifier guard.

Depending on the size and number of electronic components to be included in the housing, the size of the housing may vary. In some embodiments, the thickness of the housing in the direction normal to the surface of the handle side of the guard may be increased. In some embodiments, one or more sensors may be positioned within a housing such as the ones depicted in FIGS. 2A, 2B, 4A, 4B, and 5A-5C and an additional housing may contain other electronic components which may be positioned away from the pacifier nipple or guard (e.g., a processor, a transceiver, a battery, etc.). The two housings and the components contained therein may be flexibly or rigidly connected. For example, an umbilical may connect the two housings.

The housing may be formed from a variety of methods and materials. Methods may include molding or injection molding. Materials should be safe for children to use (e.g., non-toxic). For example, the housing may be formed via injection molding non-toxic plastic, silicone, a silicone-based compound, or other suitable material. Silicone is a durable material that also provides protection for any electronic components housed within.

Other embodiments of a housing may have different shapes or forms depending on the types of pacifiers it interfaces with and need not match the shape of the pacifier guard. Regardless of how the housing is formed, it and its constituent parts, if any, should be minimally dimensioned to comply with child safety requirements and to avoid becoming a choking hazard.

While a separate housing is suitable for interfacing to off-the-shelf pacifiers, it is not mandatory. A custom pacifier may be formed that includes the electronic components such as the ones described below in the context of FIG. 6 within the structure of the pacifier.

Electric Components

Figure 6:
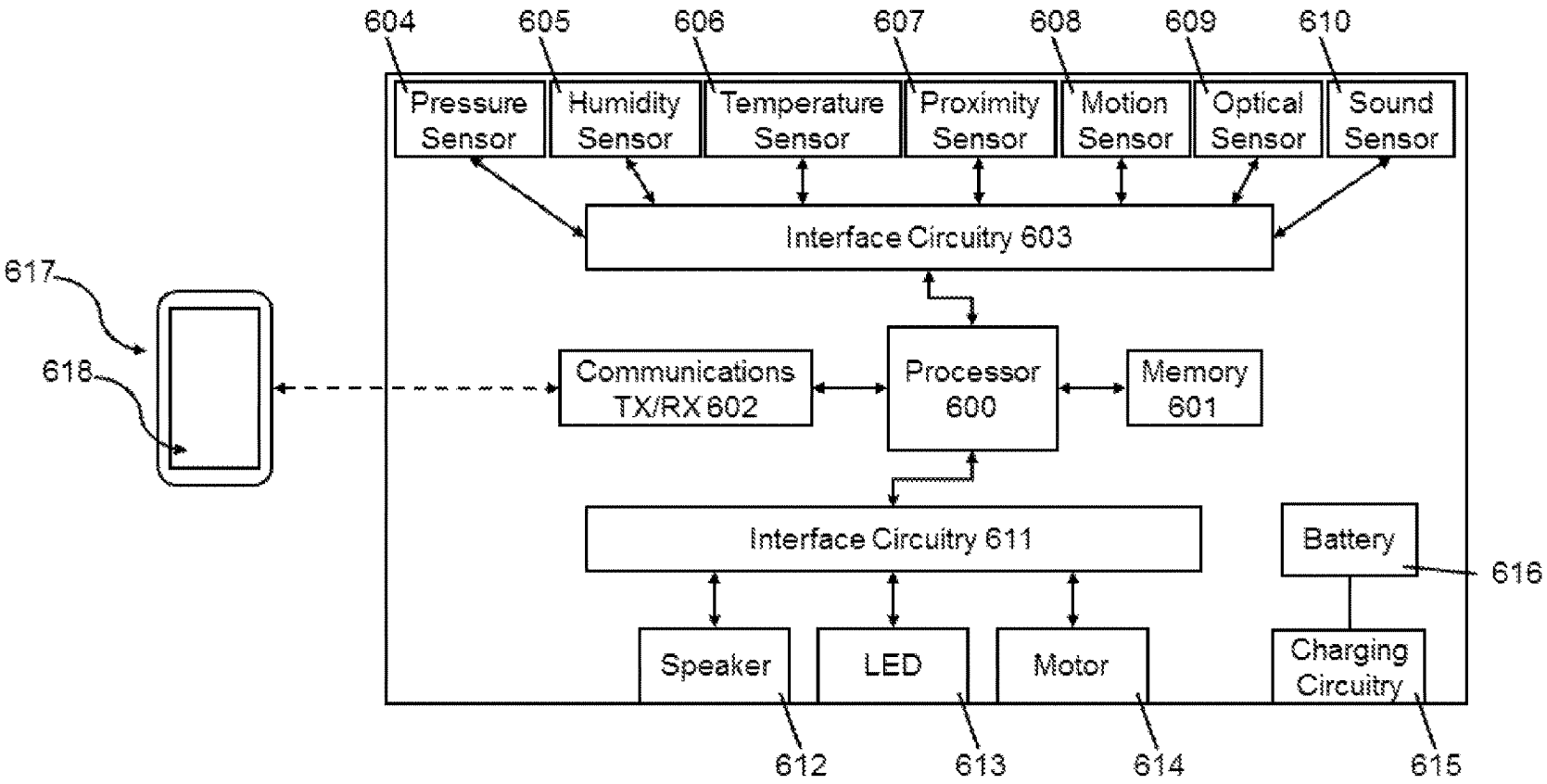
FIG. 6 is a block diagram of one embodiment of an intelligent pacifier.

FIG. 6 depicts a block diagram of the various electronic components that may be included within the pacifier. In general, various sensors 604-610 may be included to sense the environmental conditions around the pacifier. A processor uses the environmental data to evaluate the state of the pacifier. Depending on the state of the pacifier, the processor may cause any one or more of included output transducers 612-614 to provide a notification to a child or caretaker.

Sensors

The pacifier or housing may include one or more sensors to detect environmental conditions on, in, or near the pacifier.

Pressure Sensor

A pressure sensor 604 may be included to measure the air pressure within or near the pacifier. The pressure sensor may be a barometric pressure sensor, and may be placed on a surface 36 behind the nipple to measure pressure within the nipple or at locations to measure pressure changes that occur during sucking, inhalation, exhalation, or manipulation of the pacifier.

Humidity Sensor

A humidity sensor 605 may be included to measure the humidity of the air near the pacifier. The humidity sensor 605 may be placed at a location to measure humidity changes that occur during inhalation and exhalation or between being far or near a person.

Temperature Sensor

A temperature sensor 606 may be included to measure a temperature near the pacifier. The temperature sensor 606 may be placed at a location to measure temperature on or around the handle side or the nipple side of the pacifier guard, or on a surface 36 to measure the temperature of the air within the nipple.

Proximity Sensor

A proximity sensor 607 may be included to detect the proximity of the pacifier to an object. For example, a capacitive field sensor may be used to detect changes in an electric field that occur when a person is near or has touched the pacifier. As another example, a photodiode in combination with a photosensor may be used to detect a nearby object's reflection of the light emitted from the photodiode. The proximity sensor 607 may be placed on or around the handle side or the nipple side of the pacifier guard to detect whether the pacifier is being held in a hand and/or in a mouth.

Motion Sensor

A motion sensor 608 may be included to measure movement of the pacifier. A inertial measurement unit (IMU) comprised of accelerometers, gyroscopes, and magnetometers provides flexibility in terms of placement and orientation within the housing or pacifier as it will capture motion in any direction. Alternatively, one or more accelerometers, gyroscopes, rate sensors, or magnetometers may be included to provide position, velocity, and/or acceleration information.

Optical Sensor

An optical sensor 609 may be included to measure ambient lighting conditions such as whether it is day or night or the condition of the room lighting. It is preferable to position the optical sensor 609 on the pacifier or housing such that it is difficult to obstruct when resting on a surface like a bed. For example, the optical sensor 609 may be placed in a corner between the pacifier guard and handle to avoid being placed flat against a surface.

Sound Sensor

A sound sensor 610 such as a microphone may be included to measure the sound near the pacifier such as a baby's cry or coo. Like the optical sensor, it is preferable to position the sound sensor 610 on the pacifier or housing such that it is difficult to obstruct when resting on a surface.

Sensor Configuration and Placement

Multiple sensors of a particular type may be included to collect data from multiple locations, including the locations described above. While some pacifiers are designed to be used in a particular orientation and the positioning of the nose is predictable, other pacifiers are "omnidirectional" and may require additional sensors to account for variations in the pacifier orientation relative to the nose.

Interface Between Sensor(S) and Processor

Interface circuitry 603 in FIG. 6 may connect the sensor(s) to the processor 600. Interface circuitry 603 may include analog-to-digital converter circuitry to sample signals from each sensor, biasing circuitry for each sensor, and/or filter circuitry for each sensor to filter or capture certain frequency components within the signal (e.g., a high pass, low pass, band pass, or band stop filter). Interface circuitry 603 may include a separate circuit path for each sensor to the microprocessor or may multiplex data from each included sensor. Interface circuitry 603 may be omitted if the processor 600 includes circuitry to interface to the sensor(s).

Processor

Processor 600 reads or receives data from each sensor included in the pacifier or housing. Processor 600 may store sensor data in memory 601 for later communication to an external device 617 via communications circuitry 602, which includes a transmitter and a receiver. Processor 600 may also store configuration and training data in memory 601, which will be discussed below.

Figure 7:
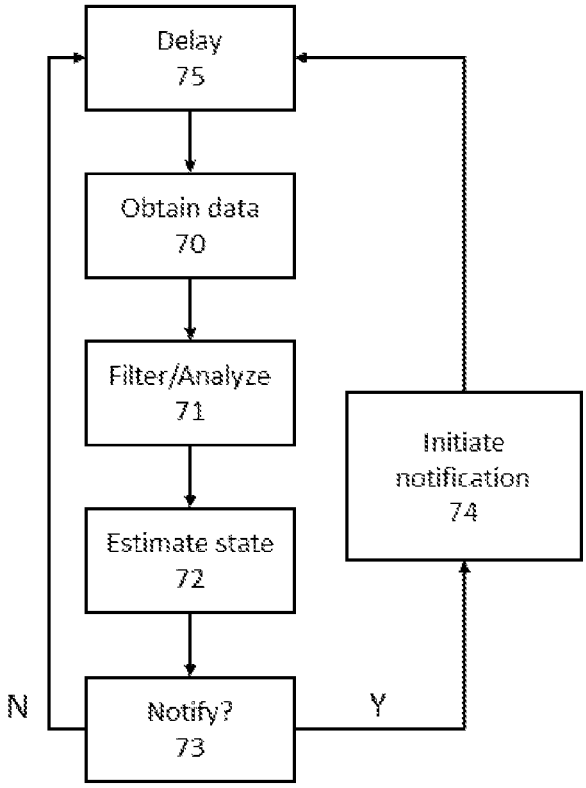
FIG. 7 is a flow chart of operations carried out by an exemplary intelligent pacifier.

FIG. 7 depicts the general flow chart that processor 600 uses during operation. Beginning at step 70, the processor obtains data from the sensor(s) by, for example, reading data from a memory or sampling data directly from the sensors. Multiple samples may be taken at step 70, each sample taken at a sampling frequency and taken together representing the signal over a period of time. At step 71, the processor filters and/or analyzes the data. If interface circuitry 603 is omitted or does not include any filtering, processor 600 may employ digital filters to filter out undesirable information or to isolate desirable information in the signal before performing an analysis. Note that the sample data may be filtered differently depending on the analysis to be performed. For example, if the sensor data is to be subjected to multiple forms of analysis, one filter may be applied to the unfiltered data for one analysis and another filter may be applied to unfiltered data for a different analysis.

Figure 8:
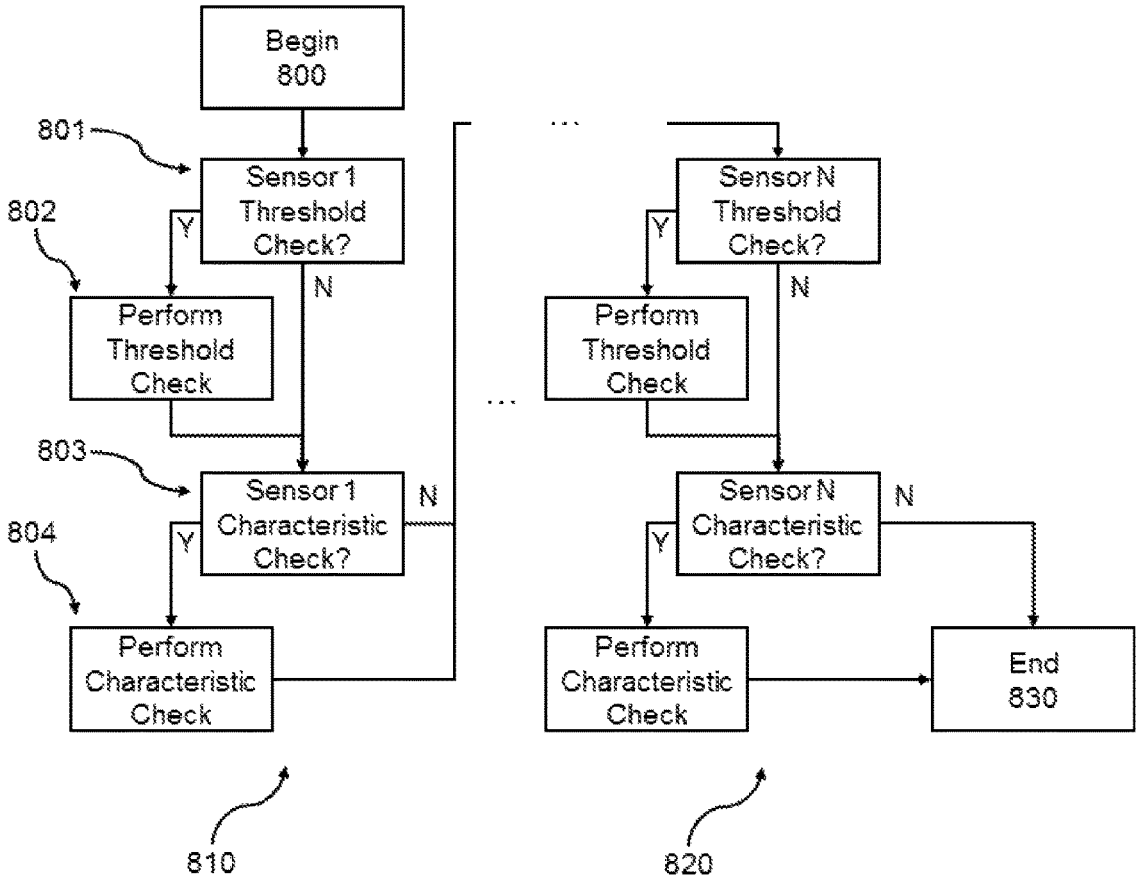
FIG. 8 is a flow chart of operations carried out by an exemplary intelligent pacifier.

FIG. 8 depicts a generic flow chart for analyzing sensor data. The data analysis is performed determine whether the data received from the sensor is indicative of the pacifier being in a particular state of use or location. Two exemplary types of checks, or tests, are described for analyzing the data, though other tests viable. The first type of check is a threshold check. In performing a threshold check, the processor compares whether the sensor data meets or exceeds a threshold (or is underneath a threshold). The threshold may be a default threshold that can be set for each type of sensor (e.g., a temperature threshold of 90° F. may indicate the pacifier is in a child's mouth). The sensor data used in this comparison may be the most recent data sample, or an average of some number of the most recent samples. The second type of check is the characteristic check. In performing a characteristic check, the processor decomposes the series of samples into constituent parts (e.g., through Fourier analysis). The decomposed data may itself be subject to a threshold check. For example, an infant's cry may be characterized by a low frequency component due to inhalation and exhalation along with several components in the audible frequency range that represent the cry vocalization. The processor may match the decomposed samples against this characteristic cry by comparing the coefficients of the corresponding frequencies.

The outcome of a check may be a binary value (e.g., pass or fail) or a non-binary value (e.g., how much a value exceeded a threshold by or the RMS value of the difference between the coefficients and their minimum value in a characteristic cry).

The process begins at step 800. Subprocess 810 performs the analysis for data from a single sensor. At step 801, the processor 600 checks whether to perform a threshold check, either performing the check at step 802 or skipping to step 803 to determine whether to perform a characteristic check. If necessary, the characteristic check is performed at step 804.

If there are N total sensors, an additional subprocess 820 may be carried out for each sensor. While the steps in FIG. 8 are depicted sequentially, the various steps for each sensor may be performed in parallel. In addition, certain tests or checks may be omitted as they are not helpful in analyzing the data obtained from a particular sensor type (e.g., temperature data could only be compared against one or more thresholds rather than being decomposed into its component parts for analysis). For example, data from a pressure sensor may be analyzed using a characteristic check to evaluate whether the pacifier is being sucked. Data from the temperature, proximity, and/or optical sensors may be analyzed using a threshold check to evaluate whether the pacifier is in use, being held in a hand, or in a lit or unlit room, respectively. Data from the humidity, motion, and/or sound sensors may be analyzed using both a threshold check and characteristic check to evaluate whether the pacifier is being sucked or whether a child is crying. Note that the filtering of the sample data may vary depending on the type of check being performed. For example, in the case of motion data, performed a threshold check to estimate whether the pacifier is being carried or swung in a hand may be possible with unfiltered data. At the same time, if the motion data is being analyzed to detect breathing patterns, a low pass filter may be used before performing a characteristic check.

Returning to FIG. 7, step 72 involves the processor performing an estimate of the state of the pacifier given the analysis results of the data obtained the sensors. The processor bases its state estimate on one or more of the sensor checks performed in step 71. The table illustrated in FIG. 9 provides an example of how the processor may perform such an estimate. The leftmost column includes an exemplary list of pacifier states to be differentiated amongst. The remaining columns represent the sensors and the outcome of the various checks that may have been performed on the data collected from them. For example, the processor may estimate the state of the pacifier to be not in use, but needed when it detects a certain level of motion and noise from the motion and sound sensors from, for example, a fussing, restless child (Motion: T=1; C=0; Sound: T=1; C=0). The processor may estimate a state having a higher degree of need may be estimated when those same conditions are met, but a sound sensor characteristic check indicates the child is crying (Motion: T=1; C=0; Sound: T=1; C=1). Certain sensors and checks may be unnecessary in differentiating between states, and the particular pass/fail conditions for a check may vary depending on the positioning of the sensor.

Additional states and variables may be present in other embodiments of the invention. Alternative ways of estimating the states may also be considered. For example, the processor may attempt to detect whether an emergency condition exists by evaluating a timer and using sequential rather than combinatorial logic. As an example, the processor may generate an emergency alert if it (a) estimates the state to be in the child's mouth and (b) fails to detect breathing characteristics in the humidity, motion, and/or pressure sensor data for (c) a period of time (e.g., 10 seconds).

Certain sequences of states or patterns in data may be used to predict a child's behavior. For example, a change in sucking frequency (based on data from one or more sensors) may be a sign of future distress of the child or correlated to respiration rate. Such predictions may be sent to a caretaker in the form of an alert to prevent a future event.

Note that while the table shown in FIG. 9 depicts check results in the form of binary values (i.e., '1' or '0'), the threshold and characteristic checks may provide additional information in the form of a non-binary vale (e.g., 0.8 or 1.5). The processor may use Bayesian logic to estimate the state of the pacifier given the various sensor checks.

Returning to FIG. 7, in step 73 the processor determines whether the pacifier should output a notification or alert of its presence. Taking the states in FIG. 9 as an example, the processor may determine a notification is required if the estimated state of the pacifier is not in use and needed. If a notification is required, the processor will initiate the notification at step 74 by activating one or more output transducers, discussed below.

| Pacifier Environment State | Notification Level |
|---|---|
| Not in use, needed (child in discomfort) | 1 |
| Not in use, needed (child in distress) | 2 |
| Not in use, not needed | 0 |
| In hand | 0 |
| In use | 0 |

Depending on the state of the pacifier, the processor may initiate a notification having a level based on the state. If the pacifier includes more than one output transducer, the processor may initiate a notification from both transducers if the child is distressed and from a single transducer if the child is in discomfort. If the pacifier includes a single output transducer, the processor may increase or decrease the frequency or amplitude of the signal output from the transducer to provide varying levels of notification.

Once a transducer has been activated, the processor returns to optional step 75. If a notification is not required, the processor returns to optional step 75. Optional step 75 includes a delay before the processor obtains sensor data and repeats the process. A delay may be desirable to reduce power consumption. The length of the delay may be increased depending on the amount of power remaining in the battery 616.

Data Storage and Communications

Processor 600 may store data collected from the sensor(s) in memory 601 for later transmission to an external device having additional display and analysis capabilities. Processor 600 may be coupled to communications circuitry 602 which may include a transmitter and a receiver. Communications circuitry may transmit and receive data according to a communication protocols such as USB, Bluetooth, ZigBee, X11, and 802.11. Upon establishing communications with an external device via the communications circuitry 602, processor 600 may transmit stored data to the external device. Additionally, when a connection is established, the processor may stream data as it is collected from the sensors in real-time. The processor may receive various configuration settings from the external device.

A caretaker has the option of partially or completely disabling the communications circuitry when the pacifier is in close proximity to the child. For example, a caretaker may wish to disable a transmitter part of communications circuitry 602. Such an option may be available via a configuration setting available in an associated application program running on an external device. Additionally, the processor 600 may disable the transmitter automatically when the processor 600 estimates the pacifier to be in use. A receiver part of communications circuitry 602 may await a "wake-up" signal from the application program before the transmitter is enabled. In some embodiments, a physical switch may be included to manually enable or disable all or part of communications circuitry.

In some embodiments, processor 600 may communicate with another device in a manner compatible with a third-party software application or protocol. For example, processor 600 may be configured to communicate with a third-party software application so that the pacifier appears as a compatible slave, source, or other device having available information. After establishing communications with the pacifier, the processor formats sensor data for transmittal. For example, the data may be packetized. A packet may include a header, payload, and, optionally, a footer. The header and or footer may provide an indication of the type of sensor data contained in the payload. The third-party software application may begin to collect data from the pacifier either periodically or in real-time.

Interface Between Processor and Output Transducers

Interface circuitry 611 in FIG. 6 may connect the output transducer(s) to the processor 600. Interface circuitry 611 may include digital-to-analog converter circuitry to convert digital signals from the processor to appropriate analog signals for controlling the output transducers. Interface circuitry 611 may further include filter and drive circuitry to smooth the digital-to-analog output and to power the output transducers. Interface circuitry 611 may include a separate circuit path for each output transducer from the processor or may multiplex control signals to the various output transducers. Interface circuitry 611 may be omitted if the processor 600 includes circuitry to interface to the output transducer(s).

Output Transducers

The pacifier or housing may include one or more transducers to provide a notification or alert of the pacifier's presence.

Speaker or Other Sound Source

A speaker 612 may be included to produce a sound in response to a signal from the processor 600. The duration and loudness of the sound may vary, and the sound may be repeated periodically. The sound may be a chime, ring, bell, or other similar sound. The sound be the reproduction of a melody such as one from a children's nursery rhyme or song.

In embodiments having a speaker, the processor may track how much time the pacifier is idle. If the pacifier remains idle for a period of time exceeding a threshold (e.g., one day, three days, five days), the processor may cause the speaker to occasionally chirp to allow a caretaker or child to locate it even when in an idle state.

Note that in embodiments including a vibration motor or other motion source, the motor may be used to create a sound as the pacifier or housing vibrates or moves against a surface.

Light Emitting Diode(S) or Other Light Source

A light-emitting diode 613 may be included to produce a light or glow in response to a signal from the processor 600. The LED 613 may produce different color light and emit the light through a diffusion filter to provide a glow or other effect. If the construction of the housing or pacifier is made out of a translucent material, the LED 613 may be encased within the housing or pacifier, or positioned in the housing to direct light into the pacifier shield or nipple in order to create a glow effect. The LED 613 may blink or have its brightness adjusted with circuitry that regulates the amount of current flowing through the LED (e.g., a variable resistor).

Vibration Motor or Other Motion Source

A motor 614 may be included to produce a movement such as a vibration or an audible buzz in response to a signal from the processor 600. One such motor is a vibration motor. An example of such a motor can be a linear resonant actuator (LRA) or an eccentric rotating mass (ERM) vibration motor. The processor 600 may control the amplitude, frequency, and duration of the signal used to drive the motor to control the movement. Pulse width modulation may be used to control the speed of the vibration. In addition, a vibration motor 614 may be activated when the processor 600 estimates that pacifier is in the mouth of a child. Activating the motor in this state may stimulate the gums and ease child discomfort associated with teething.

Power

As shown in FIG. 6, the pacifier or housing preferably includes a battery 616 for powering the other electronic components shown therein. A replaceable battery may be used, though the access to the battery compartment should be child proof to avoid disassembly as the battery may present a choking hazard. Preferably the pacifier or housing includes a rechargeable battery 616 and charging circuitry 615 for recharging the battery. To limit the need for access ports, the charging circuitry may rely on inductive power transfer. A charging base (not shown) includes a loop antenna which couples to a loop antenna in the charging circuitry. When the loop in the charging circuitry and the loop in the charging base are in proximity to each other, a magnetic field coupling allows the transfer of energy from the base to the charging circuitry for storage in the battery.

External Device

As shown in FIG. 7, an external device 617 may establish communications with the intelligent pacifier. The external device 617 includes a display 618, a processor (not shown), and communications circuitry (not shown) to communicate with the pacifier. The external device may be a personal digital assistant, smartphone, tablet, laptop, computer, or other computing device.

Figure 10B:
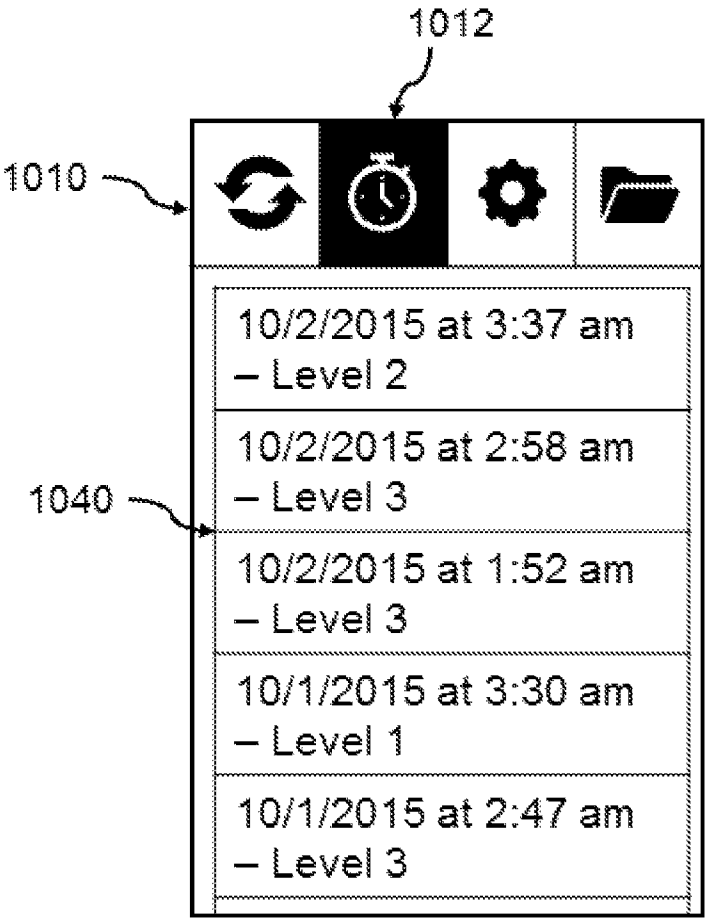
FIGS. 10A-10D depict an exemplary user interface.
Figure 10A:
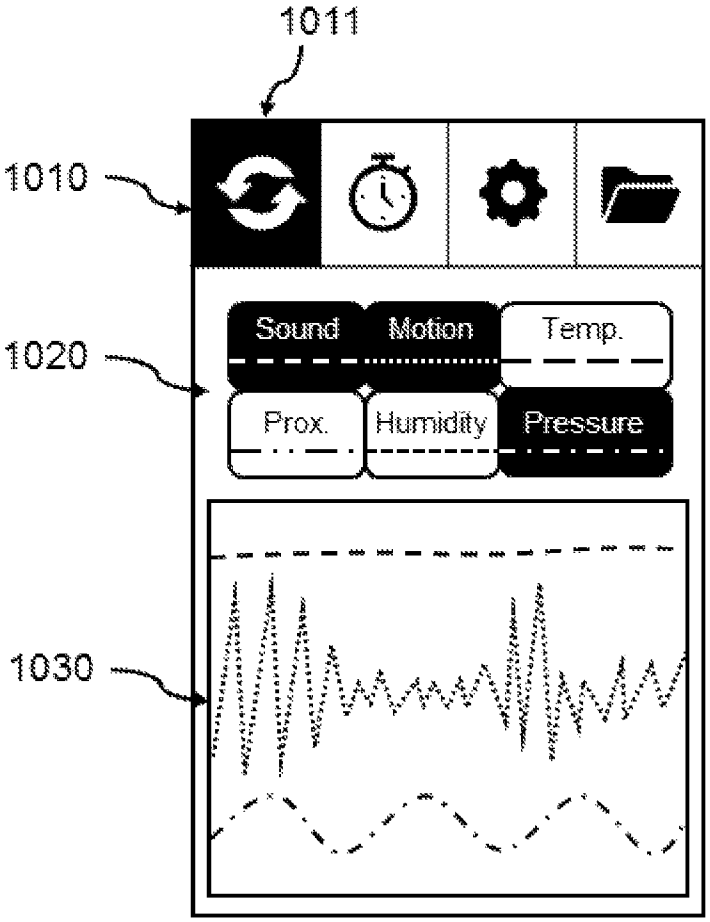

FIGS. 10A through 10D depict user interface menus that may be included in an application running on the processor of the external device. In FIG. 10A, an application user has selected a "real time" option 1011 in menu bar 1010. When a communications link between external device and pacifier are established, the user may view sensor data in real time in display area 1030. The user interface includes a display area 1020 that allows a user to toggle which sensor data is being displayed. Display area 1020 may be limited to only those sensors that are installed on the pacifier. While not shown, when a communications link can be established, the application may include an option for the user to enable the notification so as to aid in locating a lost pacifier.

In FIG. 10B, the application user has selected the notification history option 1012. Display area 1040 includes a log of each time a notification or alert was generated, including an indication of the level of the notification or alert.

Figure 10D:
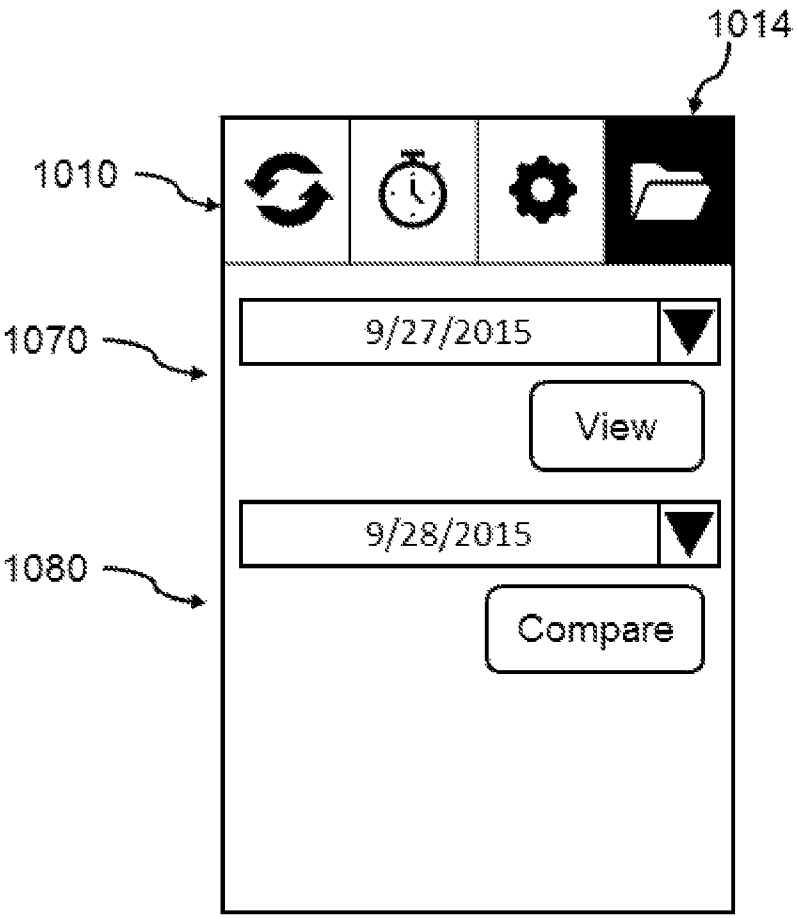
Figure 10C:
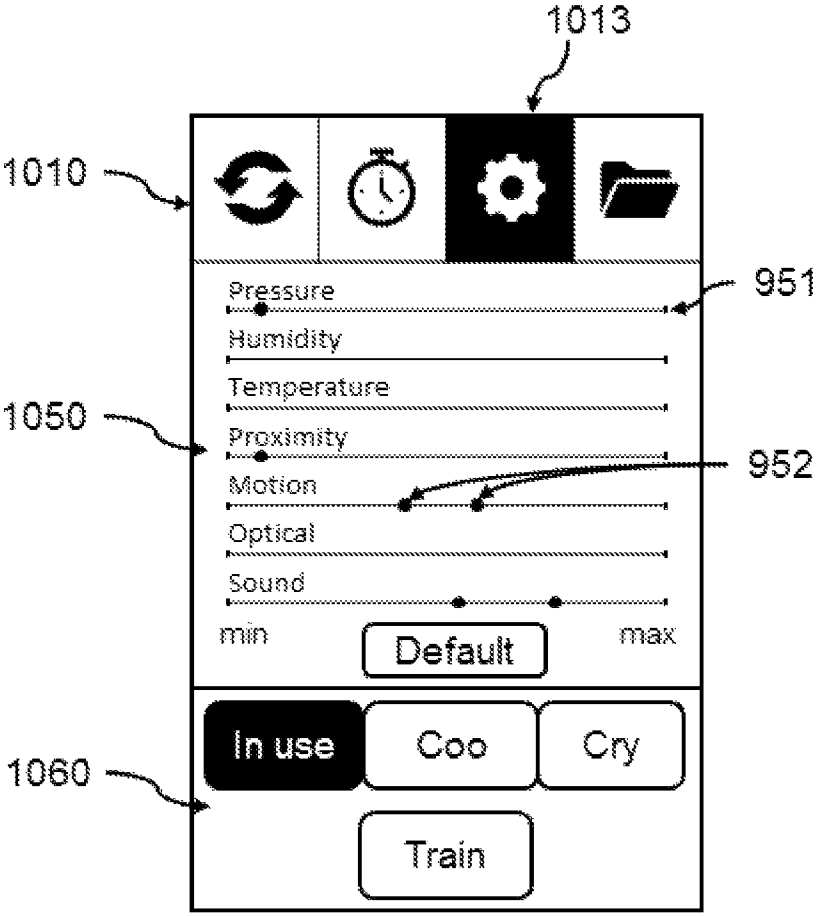

In FIG. 10C, the application user has selected the configuration option 1013. If the external device and pacifier are connected, the current thresholds used in evaluating the state of the pacifier may be displayed in display area 1050 on scales 951 by markers 952. Otherwise, the last read or default thresholds are displayed. Multiple markers 952 on a single scale 951 indicate multiple levels of notification. The user may add, move, or remove markers (thresholds) for the various sensors that may be included in a particular pacifier to tailor the pacifier to a child, or reset the thresholds to a default setting. Display area 1060 allows a user to automatically configure the pacifier to recognize various situations. For example, the user may select the "In use" option and press the "Train" button when the child or infant is calm and engaged with the pacifier. The processor 600 may enter a training mode in which it collects data for a period during which time it isolates certain signal characteristics of the data coming from the available sensors and uses that training to match to subsequently encountered states. For example, the motion, humidity, and pressure information collected while the child is sucking on the pacifier may be used as a baseline to match later motion, breathing, and pressure information encountered outside of the training mode. Similar training may be performed for additional states, subject to the child's current temperament.

In FIG. 10D, the application user has selected the archive option 1014. The archive option allows the user to view data previously collected from the pacifier, regardless of whether the external device and pacifier are currently connected. When the user selects an archive and the view button in region 1070, the types of sensor data that are available and a time series of the collected data may be displayed, similar to how it is displayed in display areas 1020 and 1030 of FIG. 10A. Additional options such as comparing a plurality of archived data sets may be provided for example in display area 1080, causing the device to display multiple sets of data for a given sensor simultaneously again list the display areas 1020 and 1030 of FIG. 10A.

Additional Configurations

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following.

The invention claimed is:

1. An apparatus comprising:

an interface to a pacifier;

a sensor configured to sense an environmental condition of the pacifier;

a processor configured to:

determine a state of the pacifier based in part on the environmental condition that was detected by the sensor; and generate a notification indicative of a location of the pacifier based in part on the state of the pacifier, wherein the location of the pacifier includes inside of a mouth of a human, or outside of the mouth of the human.

2. The apparatus of claim 1, wherein the processor is further configured to change the notification based in part on a change in the state of the pacifier.

3. The apparatus of claim 1, further comprising a communications interface configured to receive data from processor and to transmit the data to an external device.

4. The apparatus of claim 1, wherein the processor is further configured to evaluate the frequency content of a signal from the sensor in estimating the state of the pacifier.

5. The apparatus of claim 1, wherein the state of the processor comprises an indication of whether the pacifier is in use.

6. The apparatus of claim 1, wherein the environmental condition comprises one or more of a humidity, a motion, a temperature, a sound, an air pressure, and a proximity to an object.

7. The apparatus of claim 1, wherein the notification comprises one or more of a light, a movement, and a sound.

8. The apparatus of claim 1, wherein the interface secures the pacifier such that a portion of the apparatus is partially inserted into a hollow in a nipple of the pacifier.

9. The apparatus of claim 1, wherein the interface secures the pacifier such that a portion of the apparatus partially occludes a hollow in a nipple of the pacifier.

10. A pacifier comprising:

a sensor configured to sense an environmental condition of the pacifier;

a processor configured to estimate a state of the pacifier based in part on the environmental condition that was detected by the sensor; and a transducer configured to generate a notification of a location of the pacifier based in part on the state of the pacifier, wherein the location of the pacifier includes inside of a mouth of a human, or outside of the mouth of the human.

11. The apparatus of claim 1, wherein the processor is further configured to change the notification based in part on a change in the state of the pacifier.

12. The apparatus of claim 1, further comprising a communications interface configured to receive data from processor and to transmit the data to an external device.

13. The apparatus of claim 1, wherein the processor is further configured to evaluate the frequency content of a signal from the sensor in estimating the state of the pacifier.

14. The apparatus of claim 1, wherein the state of the processor comprises an indication of whether the pacifier is in use.

15. The apparatus of claim 1, wherein the environmental condition comprises one or more of a humidity, a motion, a temperature, a sound, an air pressure, and a proximity to an object.

16. The apparatus of claim 1, wherein the notification comprises one or more of a light, a movement, and a sound.

17. The apparatus of claim 1, wherein the processor, in estimating the state of the pacifier, compares data received from the sensor representative of the environmental condition against a threshold.

18. The apparatus of claim 1, wherein the processor, in estimating the state of the pacifier, compares data received from the sensor representative of the environmental condition against a characteristic.

19. A system comprising:

a first device comprising:

a sensor configured to sense an environmental condition of a pacifier;

a processor configured to estimate a state of the pacifier based in part on the environmental condition that was detected by the sensor and a parameter;

a transducer configured to generate a notification of a location of the pacifier based in part on the state of the pacifier, wherein the location of the pacifier includes inside of a mouth of a human, or outside of the mouth of the human; and a communications interface configured to transmit information about the environmental condition of the pacifier and to receive the parameter; and a second device comprising:

a display;

a communications interface; and a processor configured to execute an application program that (1) receives information about the environmental condition of the pacifier via the communications interface; (2) transmits the parameter to the first device via the communications interface; and (3) causes the display to output a visual indication of the environmental condition of the pacifier based on the received information.

20. The system of claim 19, wherein the processor of the second device is configured to cause the display to output a user interface, the user interface having a parameter input field.

* * * * *